US007658267B1

(12) United States Patent
Welsh

(10) Patent No.: US 7,658,267 B1
(45) Date of Patent: Feb. 9, 2010

(54) APPARATUS FOR HOLDING SCUBA TANKS

(76) Inventor: James E. Welsh, 204 E. I, Shelton, WA (US) 98532

( * ) Notice: Subject to any disclaimer, the term of this patent is extended or adjusted under 35 U.S.C. 154(b) by 58 days.

(21) Appl. No.: 11/825,668

(22) Filed: Jul. 6, 2007

(51) Int. Cl.
*E04G 1/00* (2006.01)

(52) U.S. Cl. ..... 182/181.1; 182/153; 248/151; 248/150; 248/310; 108/25; 206/349

(58) Field of Classification Search ..... 182/181.1, 182/153; 248/150, 151, 310, 229.12, 229.14, 248/229.22, 229.24, 228.5, 230.5, 231.61; 108/25; 206/349
See application file for complete search history.

(56) References Cited

U.S. PATENT DOCUMENTS 1,345,247 A * 6/1920 Robbins ..... 144/285
2,522,096 A * 9/1950 Cooke ..... 248/166
2,588,596 A * 3/1952 Weber ..... 248/311.2
3,034,153 A * 5/1962 Sargent ..... 5/98.1
3,135,391 A * 6/1964 Umstead ..... 211/85
3,181,483 A * 5/1965 Devitt et. al. ..... 108/25
3,227,284 A * 1/1966 Smith ..... 211/85.19
3,241,633 A * 3/1966 Bond et. al. ..... 182/28
3,530,955 A * 9/1970 Rice ..... 182/181.1
3,651,787 A * 3/1972 Cooper ..... 119/51.01
3,693,555 A * 9/1972 Holtzmann ..... 108/25
3,893,569 A * 7/1975 Hoch ..... 211/74
D243,889 S 3/1977 Walters
4,044,723 A * 8/1977 Fitzpatrick ..... 119/61.5
4,168,007 A 9/1979 Rohatensky
4,310,134 A * 1/1982 Schopp et al. ..... 248/210
4,570,915 A * 2/1986 O'Hern ..... 269/295
4,798,360 A * 1/1989 Alter ..... 248/311.2
4,804,064 A 2/1989 Coultrup et al.
4,880,080 A 11/1989 Brockman
4,940,003 A * 7/1990 Mayhew et al. ..... 108/44
5,025,935 A 6/1991 Hadacheck
5,096,019 A 3/1992 Kelsay
5,141,194 A * 8/1992 Burgess et al. ..... 248/311.2
5,215,162 A 6/1993 Parks et al.
5,297,655 A 3/1994 Wolfe
5,299,721 A * 4/1994 Cummings ..... 224/406
5,299,861 A * 4/1994 Foliot et al. ..... 312/194
5,333,823 A * 8/1994 Joseph ..... 248/146
5,439,073 A 8/1995 Johnson
5,501,158 A * 3/1996 Cheney ..... 108/165
5,542,359 A * 8/1996 Polries ..... 108/26
5,584,531 A * 12/1996 Bowman ..... 297/245

(Continued)

*Primary Examiner*—J. Allen Shriver, II
*Assistant Examiner*—Nkeisha J Smith
(74) *Attorney, Agent, or Firm*—Brian J. Coyne

(57) ABSTRACT

Portable apparatus for receiving and supporting scuba diving tanks when not in use. A collapsible or folding sawhorse supports an overlying scuba tank caddy. The caddy includes a horizontal top panel and a horizontal lower panel disposed below the top panel. The top panel has one or more openings adapted to receive a scuba tank. Each scuba tank, when inserted through an opening in the top panel, is supported by the lower panel, which in turn is supported by the sawhorse whereby the tank is maintained upright within the caddy and at a height suitable for a diver to mount a tank from the caddy to his back and vice-versa. In one embodiment, intended for two or more divers who each wear a single scuba tank, the openings are spaced about two feet apart. In an alternative embodiment, intended for a diver who wears dual scuba tanks, the openings are spaced about six inches apart.

3 Claims, 5 Drawing Sheets

U.S. PATENT DOCUMENTS 5,730,081 A * 3/1998 Tsengas ..... 119/51.5
5,975,475 A 11/1999 Chaplin
6,059,071 A * 5/2000 Appezzato ..... 182/181.1
6,427,804 B1 * 8/2002 Lazarus ..... 182/153
6,564,903 B2 * 5/2003 Krajec ..... 182/153
6,637,350 B2 * 10/2003 McKsymick ..... 108/25
6,814,333 B1 * 11/2004 Freiburger ..... 248/150
7,191,712 B2 * 3/2007 Goldberg et al. ..... 108/26

* cited by examiner

APPARATUS FOR HOLDING SCUBA TANKS

CROSS REFERENCE TO RELATED APPLICATIONS

None.

STATEMENT REGARDING FEDERALLY APPROVED RESEARCH OR DEVELOPMENT

None.

BACKGROUND OF THE INVENTION

1. Field of the Invention

This invention relates generally to apparatus for receiving and holding scuba tanks when not in use, and, in particular, to such apparatus that is portable.

2. General Background

When scuba diving, it is useful and convenient to have apparatus that can be brought near to, or upon, scuba divable waters, which apparatus can there receive, and temporarily support and hold, one or more scuba diving tanks when the tanks are not in use—for instance, during the divers' rest periods. To facilitate removal of the tank(s) from the apparatus and the mounting of the tank(s) onto the back of a diver, as well as for thereafter dismounting the tank(s), such apparatus should hold the tanks upright.

U.S. Pat. No. 5,299,721 to Cummings disclosed apparatus for holding at least one scuba tank within a boat. The apparatus included a receptacle, a cover covering the receptacle interior and having holes for receiving scuba tanks, and lock plates adjustably slidably mounted on side walls of the receptacle for engagement with the boat. The apparatus further included a shelf selectively positionable between the bottom and the cover below the opening for supporting a scuba tank extending upwardly through the opening in an elevated condition and spaced from the bottom for facilitating lifting of the scuba tank from the receptacle. The apparatus disclosed by Cummings is unsuitable, however, for scuba divers who either lack access to a suitable boat, or who prefer to enter divable waters from an adjacent shore and desire to keep their scuba tanks on dry shore land during rest periods. For such divers, the apparatus should preferably hold the scuba tanks upright above ground level and adjacent to the back of a scuba diver who stands with his/her back toward the apparatus.

U.S. Pat. No. 4,168,007 to Rohatensky disclosed a scuba tank rack for holding four scuba tanks and regulators, intended especially for storing scuba tanks, with accessories attached, in an automobile, on the deck of a boat, raft or the like. U.S. Pat. No. 5,028,935 to Hadacheck disclosed a portable, upright scuba tank retention rack adapted for use in the bed of a pickup truck. The racks disclosed by Cummings and by Hadacheck likewise lacked provision for supporting the tanks at a suitable height above ground level.

SUMMARY

Accordingly, there remains a need for a portable apparatus for receiving, supporting scuba tanks, upright, on land, and at a suitable height above ground level to facilitate a scuba diver's mounting and dismounting the tanks while standing adjacent to the apparatus with his back toward the apparatus. The apparatus comprises a portable, collapsible or folding sawhorse and a scuba tank caddy that is attached to and overlies an upper portion of the sawhorse. The sawhorse includes a cross bar that extends longitudinally from a first end to an opposite, second end. Upper portions of first and second pairs of sawhorse legs are attachable to the first and second ends of the cross bar, respectively, preferably by suitable sockets mounted at four corner locations of the cross bar. The caddy includes a horizontal top panel, which panel has at least one opening adapted to receive a lower portion of a scuba tank inserted through said opening. The caddy further includes means attached to the cross bar for supporting the top panel above the cross bar, which means are preferably first and second end panels attached to, and extending upward from, the first and second ends of the cross bar, respectively. The caddy also includes means, disposed below the top panel, for supporting each scuba tank inserted through each opening in the top panel in an upright position, which means preferably includes a horizontal, lower panel having a first end attached to the first end panel and an opposite, second end attached to the second end panel.

In a first embodiment, intended for two scuba divers, each of whom wears a single scuba tank on his back, the top panel has two openings spaced about two feet apart. A plurality of spacer plates may also be inserted between the sawhorse cross bar and the lower panel to assist in supporting the weight of one or more scuba tanks within the caddy. In a second embodiment, intended for a single diver who wears dual scuba tanks on his back, the top panel has two openings spaced about six inches apart and the lower panel has two cutouts in vertical registration with said openings and spaced about six inches apart.

BRIEF DESCRIPTION OF THE DRAWINGS

Similar numerals denote similar components of the invention throughout the several figures.

DESCRIPTION OF THE PREFERRED EMBODIMENT

Figure 1:
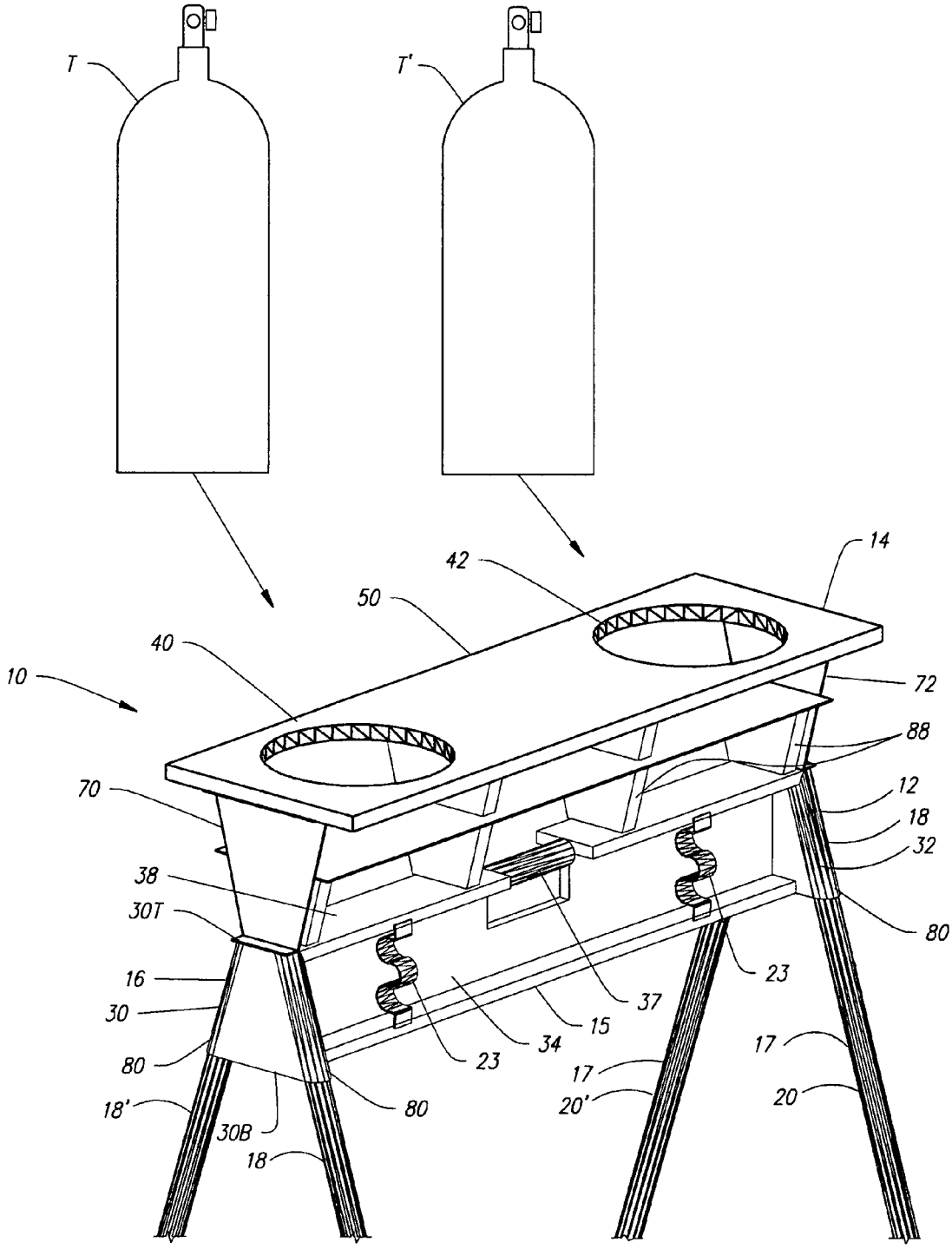
FIG. 1 is a front, perspective view of a first embodiment of the invention, which is capable of receiving and supporting one scuba tank for each of two divers.
Figure 2:
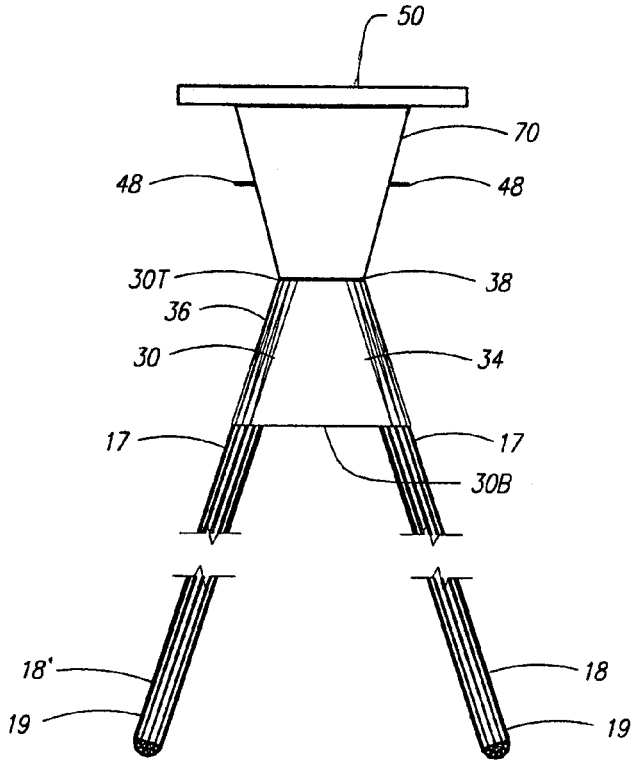
FIG. 2 is a left end elevational view thereof.
Figure 3:
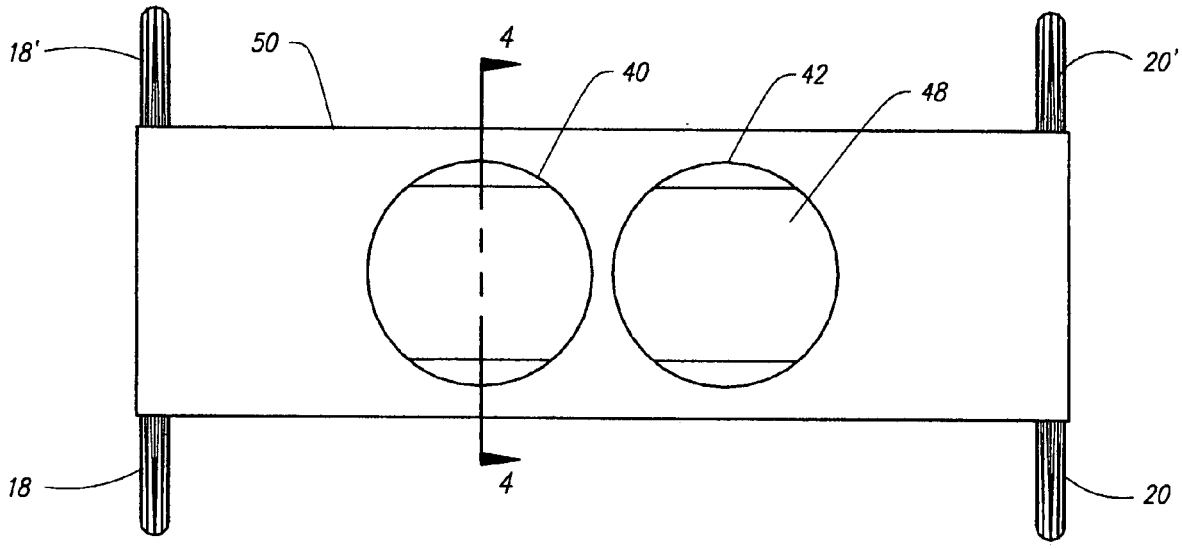
FIG. 3 is a top plan view thereof.
Figure 4:
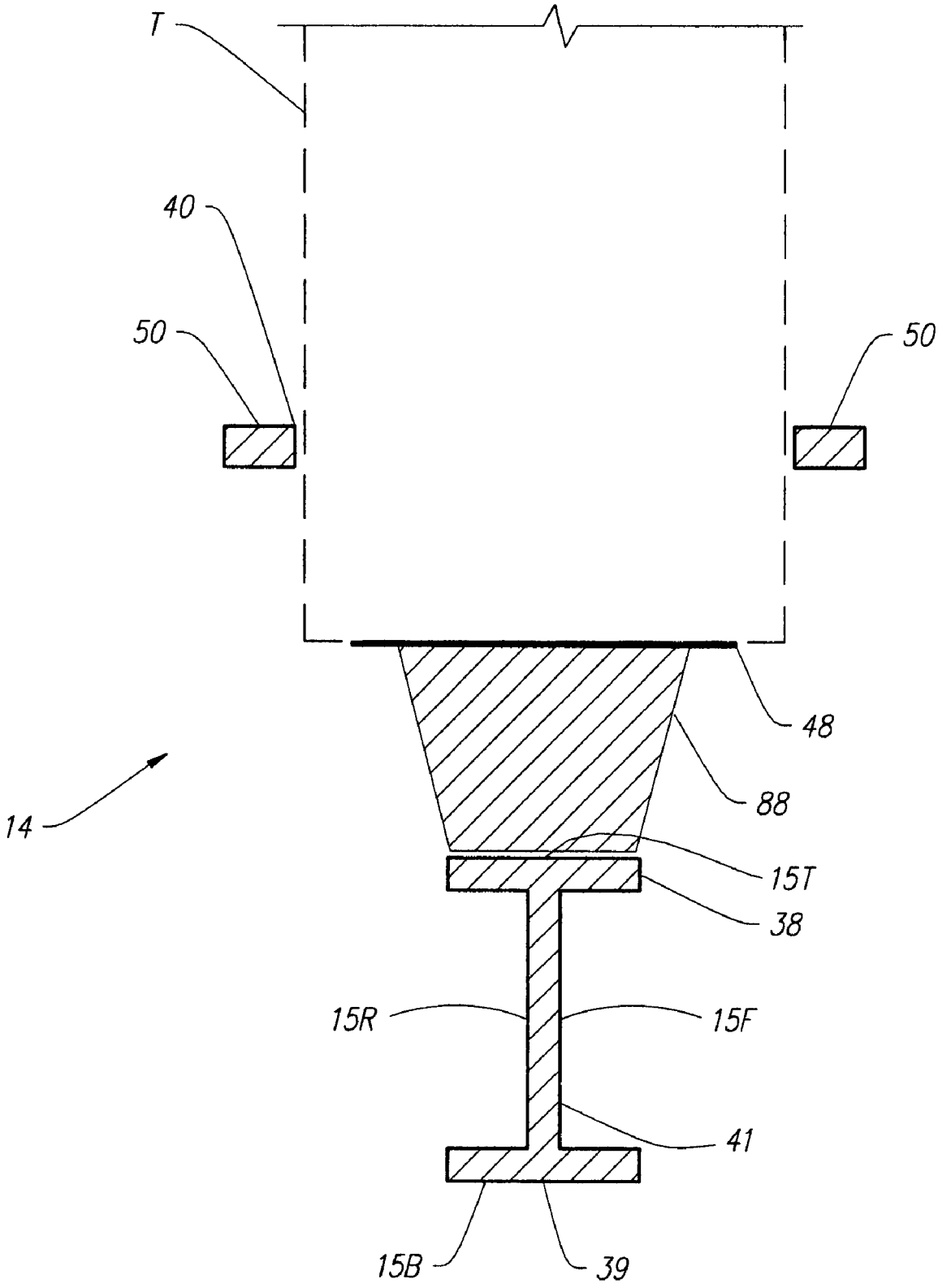
FIG. 4 is an enlarged, schematic, vertical and lateral cross-sectional view thereof taken along line 4-4 of FIG. 3, with a scuba tank stored therein (depicted in partial, phantom outline), showing a spacer plate inserted between the sawhorse crossbar and the lower panel of the caddy.
Figure 6:
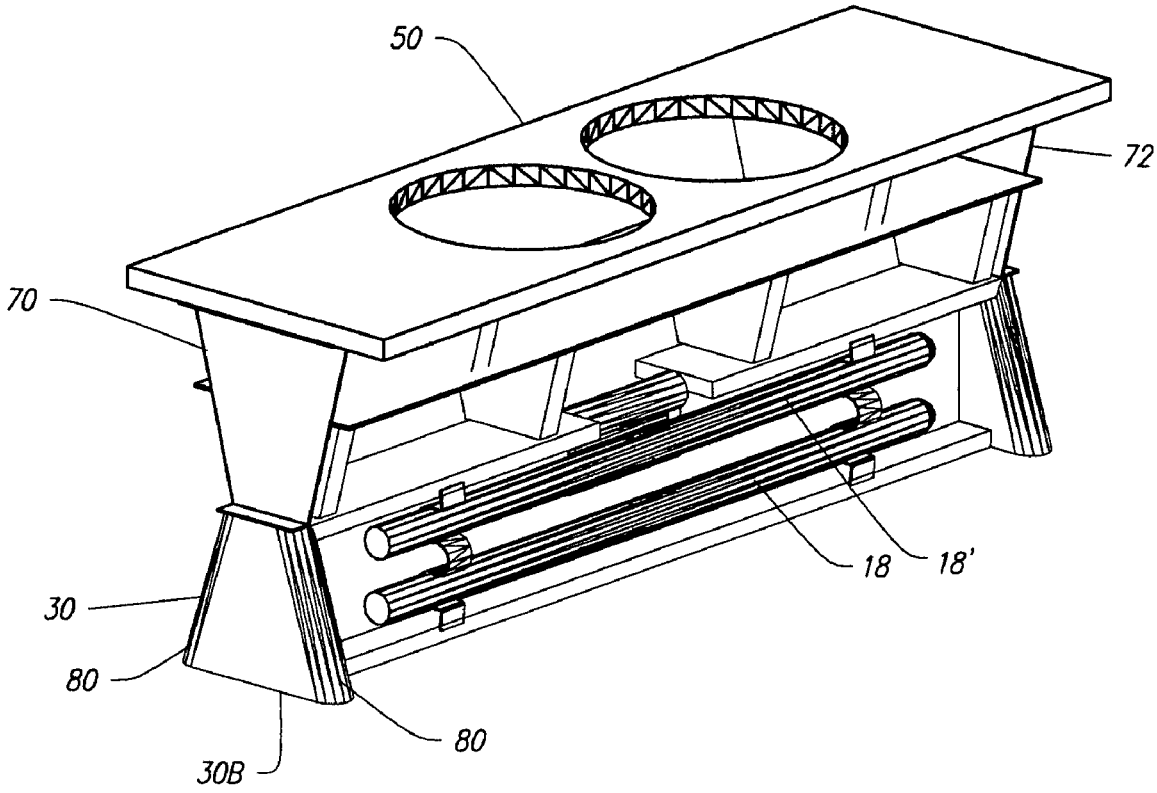
FIG. 6 is a perspective view of the first embodiment of the invention, collapsed, showing the legs stored in clips on the sides of the sawhorse.

Referring to FIG. 1, a first embodiment of the present invention, denoted generally by the numeral 10, is shown to include a collapsible saw horse 12 that supports an overlying, attached scuba tank caddy 14 A variety of collapsible or folding sawhorses can be adapted for use in the invention as a support for the caddy 14, for example, the sawhorses disclosed in U.S. Pat. No. 4,804,064 to Coultrup et al.; U.S. Pat. No. 5,096,019 to Kelsay; U.S. Pat. No. 4,880,080 to Brockman; U.S. Pat. No. 5,215,162 to Parks et al.; and U.S. Pat. No. 5,297,655 to Wolfe. As a further example, the foldaway, splay-legged stand disclosed in U.S. Pat. No. 5,439,073 to Johnson can also be adapted to support the scuba tank caddy 14 of the present invention. Thus, for illustrative purposes only, and without limiting the scope of the invention as set forth in the appended claims, the collapsible saw horse 12 chosen to support a scuba tank caddy 14 is that of U.S. Pat. No. 6,059,071 issued to Appezzato, which by this reference is incorporated herein, and includes an elongate cross bar 15 that extends longitudinally from a first end 16 to an opposite, second end 18. The cross bar 15 has top and bottom faces 15T, 15B and front and rear faces 15F, 15R. The sawhorse 12 further includes a first pair of saw horse legs 18, 18' that are attachable at the first end 16 of the cross bar 15, and a second pair of saw horse legs 20, 20' that are attachable at the second end 18 of the cross bar 15 for supporting the caddy 14 at a height above ground surface that is suitable for mounting and dismounting scuba tanks T, T from and to the back of a diver. Each of the legs 18, 18', 20, 20' has an upper end 17 and an opposite lower end 19 and is movable between a downward and outwardly splayed, deployed position, wherein the upper ends 17 are inserted within downwardly-directed sockets 80 located at each of four, lower, inner corner locations of the cross bar 15 as shown in FIGS. 1 and 6, and a stored position within pairs of longitudinally spaced-apart clips 23 disposed on the front and rear faces 15F, 15R of the cross bar 15 to facilitate transport and storage of the invention, as shown in FIG. 6. The cross bar 15 has attached a first, vertically-disposed, trapezoidal end plate 30 at the first end 16 and a second, vertically-disposed, trapezoidal end plate 32 at the second end 12 thereof, which plates 30, 32 are joined at their front and rear edges by a longitudinally-extended front panel 34 and a rear panel 36, respectively, and by substantially planar horizontal elongate top and bottom portions 38, 39, respectively that are attached to the top and bottom margins 30T, 30B of the front and real panels 34, 36. The top and bottom portions 38, 39 are joined by a central beam portion 41 such that the top, bottom and central beam portions 38, 39, 41 together comprise an I-beam as seen in lateral cross-section; see FIG. 4. The bottom margins 30B of the trapezoidal end plates 30, 32 are longer than the top margins 30T and the front and rear panels 34, 36 are canted downward and outward.

This first embodiment is intended for use by two scuba divers, each intending to carry a single scuba tank on his back. Accordingly there are depicted in FIG. 1 two scuba tanks T, T' that comprise no part of the invention itself, which are insertable into two longitudinally spaced-apart openings 40, 42 in the scuba tank caddy 14. The caddy 14, which is mounted to an upper portion of the sawhorse 12, includes a horizontal top panel 50 having the aforementioned openings 40, 42, means 44 attached to the cross bar 15 for supporting the top panel 50 above the cross bar 15, and means, disposed below the top panel 50, for maintaining upright the scuba tanks T, T' inserted through the openings 40, 42. The tanks ordinarily would have straps for attachment to a scuba diver back pack, such as is illustrated in U.S. Des. 243,889 to Walters, but these are omitted for the sake of clarity. In the illustrated first embodiment 10, the means 44 for supporting the top panel 50 above the cross bar 15 includes first and second caddy end panels 70, 72 attached to, and extending upward from the first and second ends of the cross bar, respectively; and, the means for maintaining upright the scuba tanks T, T' is a horizontal lower panel 48, which lower panel 48 has a first end attached to the first end panel 30 and an opposite second end attached to the second end panel 32. Preferably, the first embodiment further includes a plurality of vertical spacer plates 88 laterally disposed intermediate the first and second caddy end panels 70, 72, and inserted between the upper surface of the top of the cross bar 15T and a lower surface of the lower panel 48, to help support the weight of the lower panel and the scuba tanks T, T'. Alternatively, and especially for divers who are of short stature, the spacer plates 88 can be of reduced-height or eliminated altogether so that the height of the tanks T, T' while supported upright within the caddy 14 with the legs 18, 18', 20, 20' deployed can be lower. As may be seen in FIG. 1, Appezato's sawhorse is equipped with a carrying handle 37, which is unnecessary for present purposes, and so may be either retained or omitted.

Figure 5:
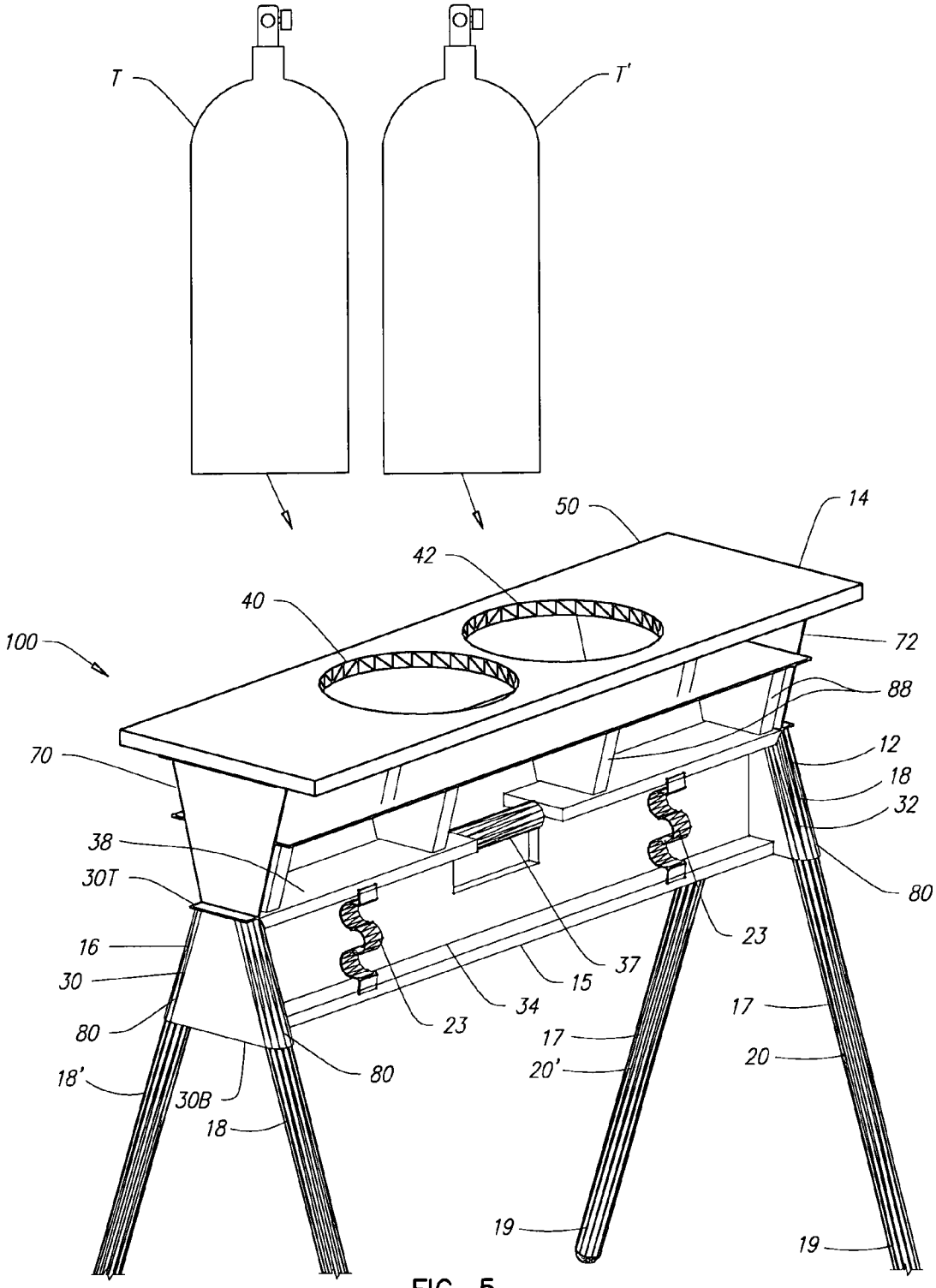
FIG. 5 is a frontal, perspective view of a second embodiment of the invention, which is capable of receiving and supporting two scuba tanks in spaced-apart relation for a single diver.

In a second, alternative embodiment, depicted in FIG. 5 and denoted generally by the numeral 100, the structure and components of the invention are the same except that the openings 40, 42 are disposed closer together longitudinally so that a pair of scuba tanks T, T' can be inserted into and stored within the caddy 14 for a single diver who chooses to wear two scuba tanks on his back while scuba diving. Whereas the longitudinal separation between the openings 40, 42 in the first embodiment 10 is preferably about two feet, the separation between the openings 40, 42 in the second embodiment 100 is preferably only about six inches, which corresponds to the distance between dual scuba tanks when worn by a single diver.

From the foregoing description it will be clear that the present invention may be embodied in other specific forms without departing from the spirit or essential characteristics thereof. Thus, the presently disclosed embodiments are to be considered in all respects as illustrative and not restrictive, the scope of the invention being indicated by the appended claims, and not limited to the foregoing description. The invention may be manufactured from any materials of suitable strength, durability and weight, which can include wood, metal (e.g., aluminum) or plastics, or any combination thereof.

I claim:

1. Apparatus for holding scuba tanks, comprising:

a collapsible saw horse, said saw horse including a cross bar that extends longitudinally from a first end to a second end, said cross bar having a top and bottom face, and a pair of laterally spaced-apart front and rear faces;

first and second pairs of elongate legs, each leg having an upper end and an opposite lower end;

said legs having a deployed position wherein an upper end of the respective leg of the first pair is attached to the first end of the cross bar and an upper end of each leg of the second pair is attached to the second end of the cross bar, and wherein each of said legs extends downwardly from the cross bar;

said legs having a stored position that is parallel and adjacent to the cross bar;

and a scuba tank caddy mounted to an upper portion of the collapsible saw horse, said caddy including a horizontal top panel that extends longitudinally from a first end to a second end, said panel having at least one opening adapted to receive a lower portion of a scuba tank inserted through said opening;

first and second end panels attached to, and extending upward from, the first and second ends of the cross bar, respectively, said top panel having first and second ends attached to said first and second end panels, respectively; and a horizontal lower panel disposed below the top panel, said lower panel having a first end attached to the first end panel and a second end attached to the second end panel and having at least one spacer plate disposed between the first and second end panels and inserted between the cross bar and the lower panel.

2. The apparatus of claim 1, wherein the top panel has at least two openings in the top panel, said openings having longitudinal spacing sufficient to accommodate one scuba tank of each of two scuba divers.

3. The apparatus of claim 1, wherein the top panel has two openings disposed centrally between the first and second ends of the top panel, said openings having longitudinal spacing that corresponds to a spacing between dual scuba tanks when worn by a single scuba diver.

* * * * *